US010568412B2

(12) United States Patent
Tomalesky

(10) Patent No.: US 10,568,412 B2
(45) Date of Patent: Feb. 25, 2020

(54) BRUSH ASSEMBLY

(71) Applicant: Charlie Tomalesky, Wilmington, NC (US)

(72) Inventor: Charlie Tomalesky, Wilmington, NC (US)

( * ) Notice: Subject to any disclaimer, the term of this patent is extended or adjusted under 35 U.S.C. 154(b) by 76 days.

(21) Appl. No.: 15/947,275

(22) Filed: Apr. 6, 2018

(65) Prior Publication Data

US 2019/0307235 A1 Oct. 10, 2019

(51) Int. Cl.

| | |
|---|---|
| ***A46B 5/00*** | (2006.01) |
| ***A47K 11/10*** | (2006.01) |
| ***A46B 17/04*** | (2006.01) |
| ***A46B 15/00*** | (2006.01) |

(52) U.S. Cl.

CPC ..... *A46B 5/005* (2013.01); *A46B 15/0095* (2013.01); *A46B 17/04* (2013.01); *A47K 11/10* (2013.01); *A46B 2200/304* (2013.01)

(58) Field of Classification Search

CPC .. A46B 5/00; A46B 5/02; A46B 5/021; A47K 11/10

USPC ..... 220/4.06

See application file for complete search history.

(56) References Cited

U.S. PATENT DOCUMENTS

| | | | | |
|---|---|---|---|---|
| 3,361,507 | A | 1/1968 | O'Neil | |
| 4,329,755 | A | 5/1982 | Alissandratos | |
| 4,915,267 | A * | 4/1990 | Buecheler | D06F 39/024 222/463 |
| 5,305,882 | A * | 4/1994 | Kaplan | A46B 5/0033 15/144.4 |
| 5,435,040 | A | 7/1995 | McClure | |
| 5,772,015 | A | 6/1998 | Musiel et al. | |
| D424,306 | S | 5/2000 | Strum | |
| 2006/0138002 | A1 | 6/2006 | Gillissie et al. | |
| 2009/0242441 | A1* | 10/2009 | Laskey | B44D 3/125 206/361 |
| 2015/0082567 | A1* | 3/2015 | Perry | A47K 11/10 15/144.4 |

* cited by examiner

*Primary Examiner* — King M Chu

(57) ABSTRACT

A brush assembly for cleaning a toilet includes a handle that comprises an upper section a lower section, and a medial section. The lower section and the medial section are nested in the upper section so that the lower section and the medial section are selectively extensible from the upper section. A scrubber is coupled to a lower end of the lower section and is configured to clean a toilet. A base, which is bowl-shaped, is positioned to partially insert the scrubber. A lid is coupled to and extends from a bottom end of the upper section. The lid is bowl-shaped and complementary the base. A perimeter of the lid is positioned to abut a circumference of the base as the lower section and the medial section are inserted into the upper section. The lid and the base define an interior space that houses the scrubber.

13 Claims, 5 Drawing Sheets

BRUSH ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION (1) Field of the Invention (2) Description of Related Art Including Information Disclosed Under 37 CFR 1.97 and 1.98

The disclosure and prior art relates to brush assemblies and more particularly pertains to a new brush assembly for cleaning a toilet.

BRIEF SUMMARY OF THE INVENTION

An embodiment of the disclosure meets the needs presented above by generally comprising a handle that comprises an upper section a lower section, and a medial section. The lower section and the medial section are nested in the upper section so that the lower section and the medial section are selectively extensible from the upper section. A scrubber is coupled to a lower end of the lower section and is configured to clean a toilet. A base, which is bowl-shaped, is positioned to partially insert the scrubber. A lid is coupled to and extends from a bottom end of the upper section. The lid is bowl-shaped and complementary the base. A perimeter of the lid is positioned to abut a circumference of the base as the lower section and the medial section are inserted into the upper section. The lid and the base define an interior space that houses the scrubber.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
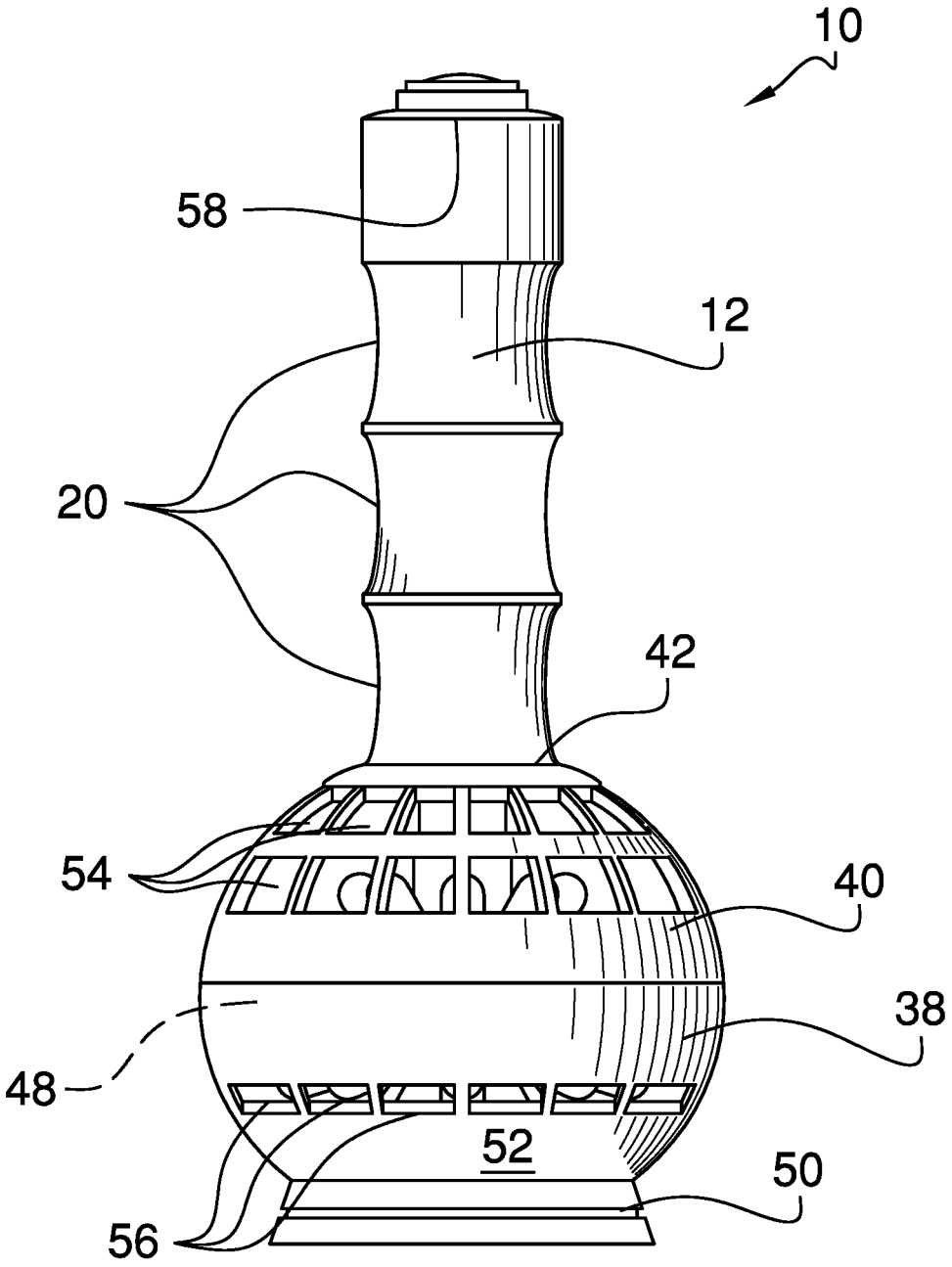
FIG. 1 is a front view of a brush assembly according to an embodiment of the disclosure.
Figure 2:
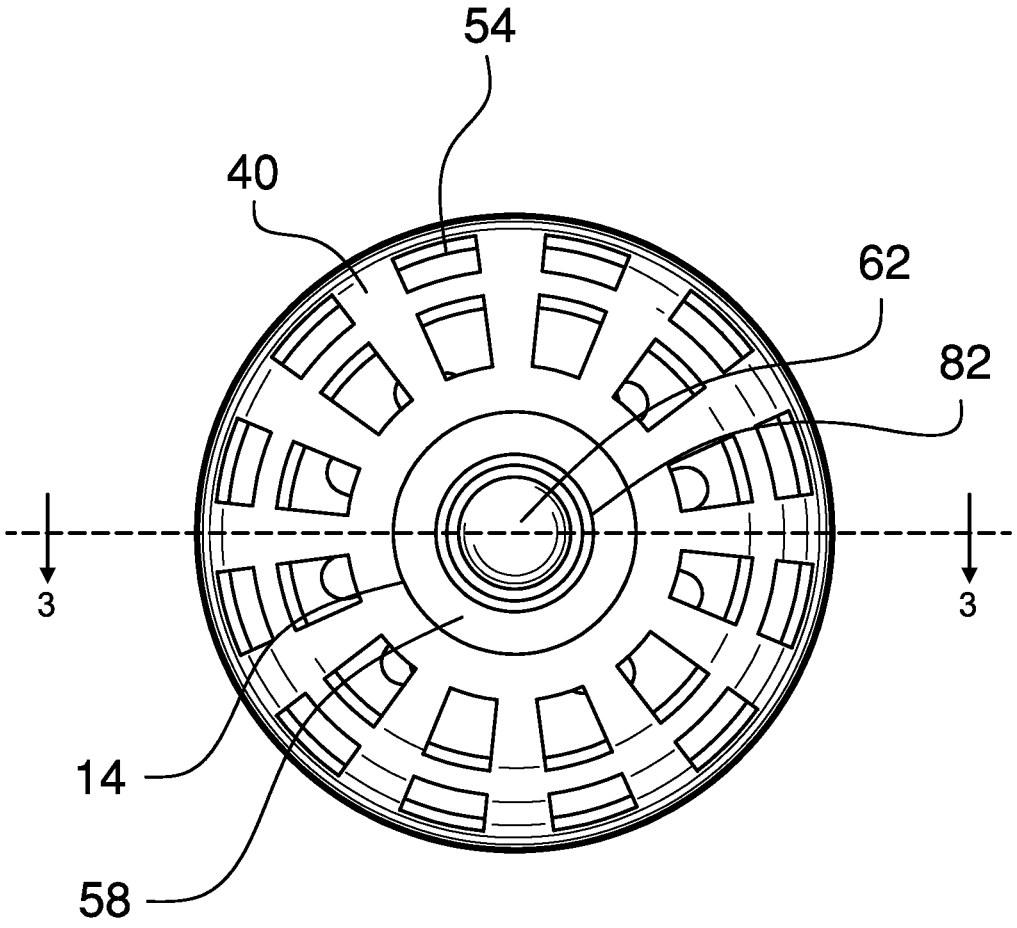
FIG. 2 is a top view of an embodiment of the disclosure.

With reference now to the drawings, and in particular to FIGS. 1 through 6 thereof, a new brush assembly embodying the principles and concepts of an embodiment of the disclosure and generally designated by the reference numeral 10 will be described.

As best illustrated in FIGS. 1 through 6, the brush assembly 10 generally comprises a handle 12 that comprises an upper section 14 and a lower section 16. The lower section 16 is nested in the upper section 14 so that the lower section 16 is selectively extensible from the upper section 14. A lower end 18 of the lower section 16 is externally threaded.

A plurality of indentations 20 is positioned in the upper section 14. The plurality of indentations 20 comprises three indentations 20. The indentations 20 are arcuate. The indentations 20 are configured to enhance a grip of a hand of a user that is positioned on the handle 12.

A scrubber 22 is coupled to the lower end 18 of the lower section 16. The scrubber 22 is configured to clean a toilet. The scrubber 22 comprises a disc 24. A hole 26 is centrally positioned through the disc 24. A tube 28 is coupled to the disc 24 and extends from the hole 26. The tube 28 is internally threaded. The tube 28 is positioned to threadedly insert the lower end 18 of the lower section 16 to reversibly couple the disc 24 to the handle 12. A new scrubber 22 can be coupled to the handle 12 as required.

A brush 30 is coupled to the tube 28. The brush 30 comprises sponge. The brush 30 comprises a core 32 and a plurality of bristles 34. The core 32 is substantially spherically shaped. Each bristle 34 is coupled to and extends radially from the core 32. Each of a plurality of wires 36 is coupled to and is positioned in a respective bristle 34. Each wire 36 extends into the core 32 so that the wires 36 are positioned to stiffen the bristles 34.

A base 38, which is bowl-shaped, is positioned to partially inserting the scrubber 22. A lid 40 is coupled to and extends from a bottom end 42 of the upper section 14. The lid 40 is bowl-shaped and is complementary the base 38. A perimeter 44 of the lid 40 is positioned to abut a circumference 46 of the base 38 as the lower section 16 and the medial section 84 are inserted into the upper section 14. The lid 40 and the base 38 define an interior space 48 that houses the scrubber 22. The interior space 48 is substantially spherically shaped.

A ring 50 is coupled to and extends from an exterior surface 52 of the base 38. The ring 50 is parallel planarly positioned relative to the circumference 46 of the base 38 so that the ring 50 is positioned to stabilize the base 38 on a horizontal surface.

A plurality of apertures 54 is positioned in the lid 40. A plurality of slits 56 is positioned in the base 38. The apertures 54 and the slits 56 are positioned to vent the interior space 48.

An orifice 82 is positioned through a top end 58 of the upper section 14. A pin 60, which is ball lock type, is positioned in the orifice 82 and is coupled to the upper section 14. A button 62 of the pin 60 protrudes from the upper section 14 and a barrel 64 of the pin 60 extends into the upper section 14, as shown in FIG. 3.

An upper washer 66 is positioned around and is coupled to the barrel 64 adjacent to the top end 58 of the upper section 14. A lower washer 68 is positioned around the barrel 64 proximate to a terminus 70 of the barrel 64. Release balls 72 that protrude from the barrel 64 of the pin 60 are positioned between the lower washer 68 and the terminus 70.

Figure 3:
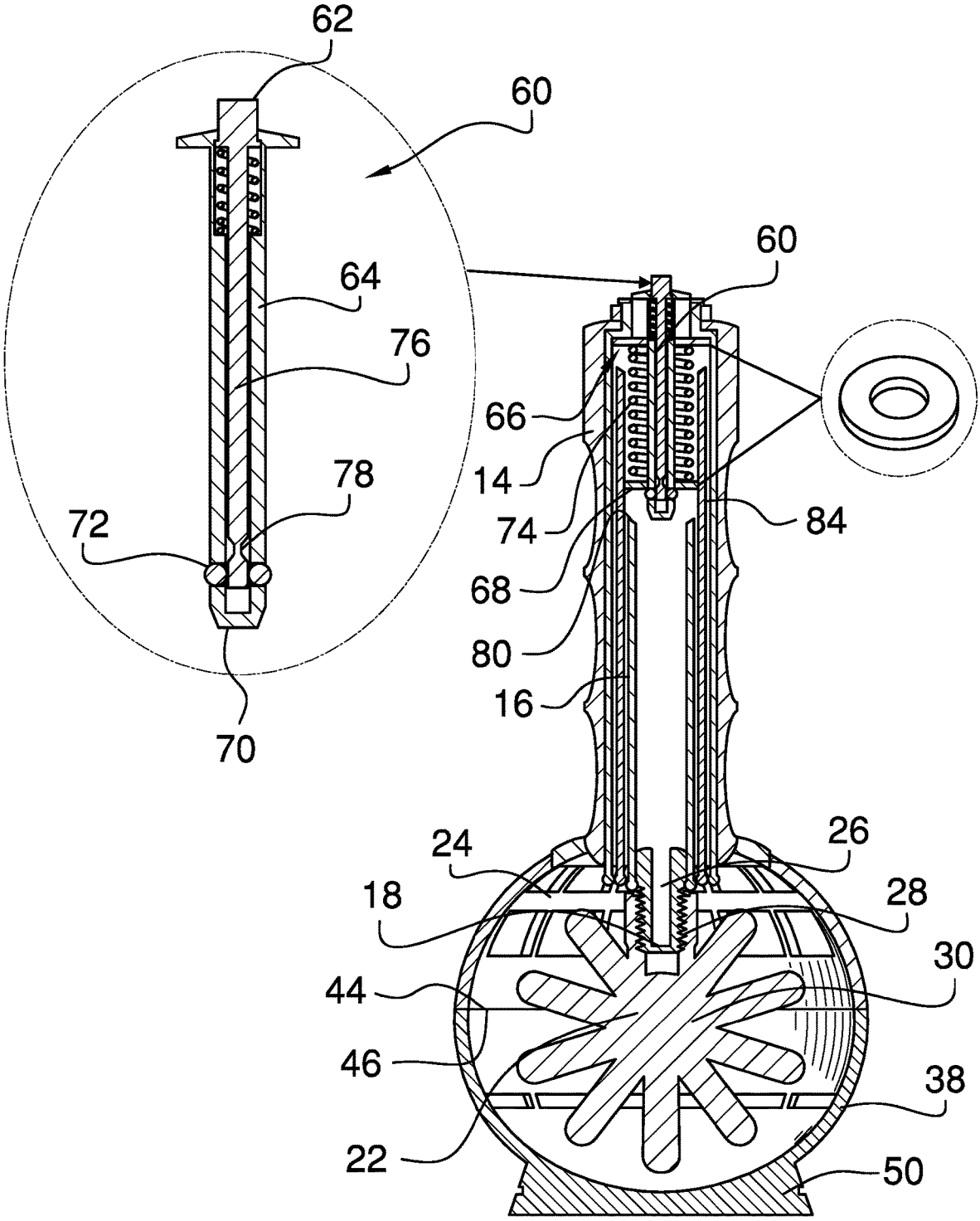
FIG. 3 is a cross-sectional view of an embodiment of the disclosure.
Figure 4:
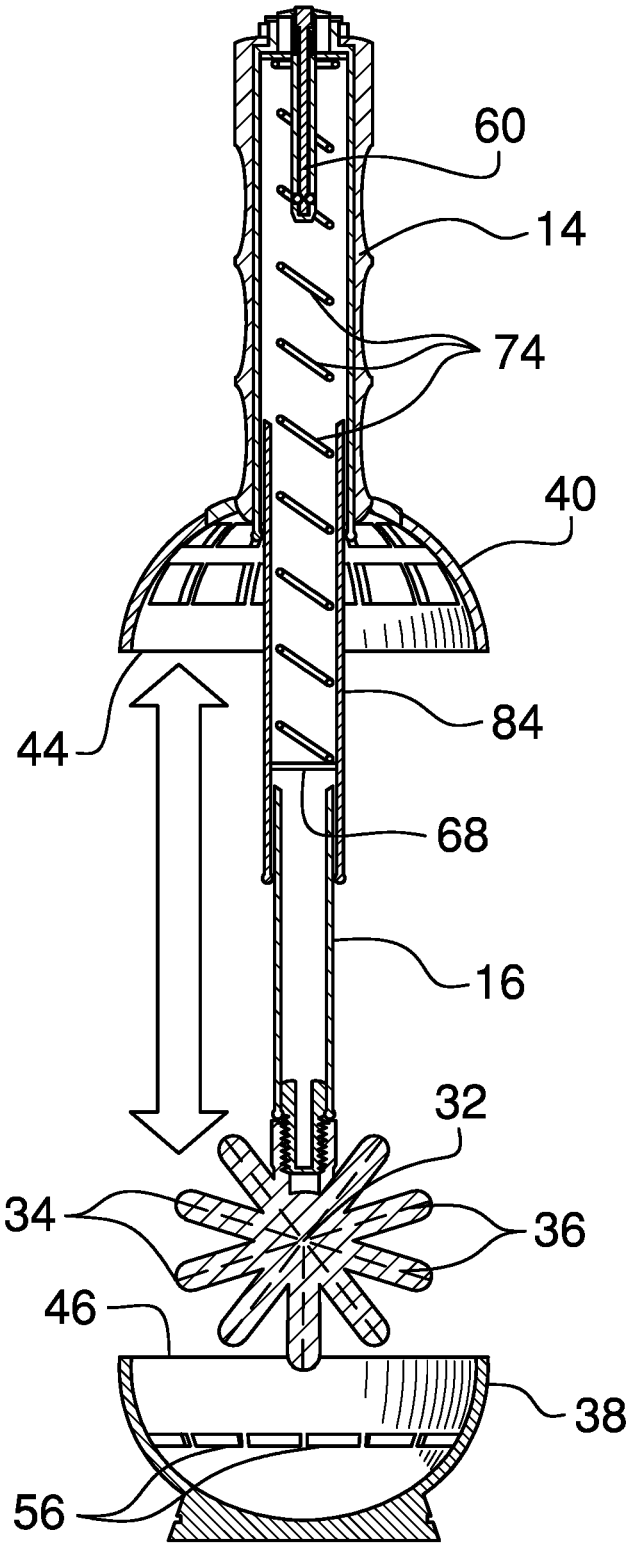
FIG. 4 is a cross-sectional view of an embodiment of the disclosure.
Figure 5:
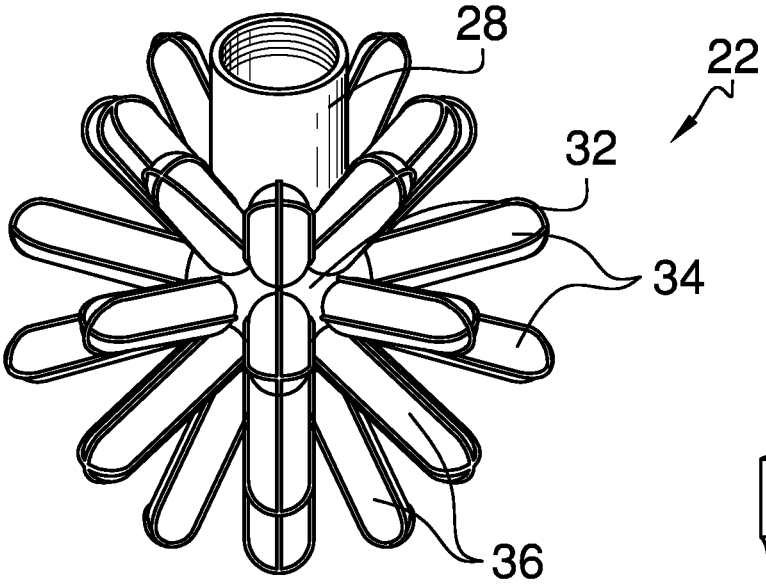
FIG. 5 is an isometric perspective view of an embodiment of the disclosure.
Figure 6:
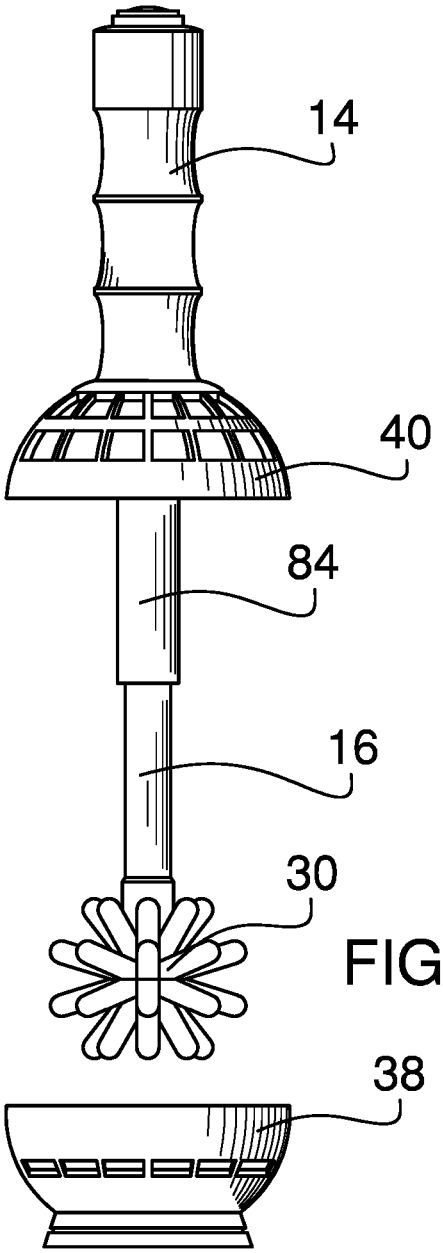
FIG. 6 is a front view of an embodiment of the disclosure.

A coiled spring 74 is positioned around the barrel 64, as shown in FIG. 3. The coiled spring 74 is coupled to and extends between the upper washer 66 and the lower washer 68. The button 62 is configured to be depressed to urge a spindle 76 of the pin 60 toward the terminus 70 to position a recess 78 of the spindle 76 to retract the release balls 72. The coiled spring 74 is positioned to urge the lower washer 68 past the release balls 72 so that the lower washer 68 contacts an upper end 80 of the lower section 16, as shown in FIG. 4. The coiled spring 74 is positioned to extend the lower section 16 and the medial section 84 from the upper section 14.

In use, the button 62 is configured to be depressed to extend the lower section 16 and the medial section 84 from the upper section 14, positioning the user to grasp the upper section 14 to manipulate the scrubber 22 to clean a toilet. The lid 40 is positioned to abut the base 38 as the lower section 16 and the medial section 84 are inserted into the upper section 14 so that the scrubber 22 is enclosed in the interior space 48 when not in use.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A brush assembly comprising:

a handle comprising an upper section, a lower section, and a medial section, said lower section and said medial section being nested in said upper section such that said lower section and said medial section are selectively extensible from said upper section;

a scrubber coupled to a lower end of said lower section wherein said scrubber is configured for cleaning a toilet;

a base, said base being bowl-shaped such that said base is positioned for partially inserting said scrubber;

a lid coupled to and extending from a bottom end of said upper section, said lid being bowl-shaped and complementary said base such that a perimeter of said lid is positioned for abutting a circumference of said base as said lower section is inserted into said upper section wherein said lid and said base define an interior space housing said scrubber; and a ring coupled to and extending from an exterior surface of said base, said ring being parallel planarly positioned relative to said circumference of said base such that said ring is positioned for stabilizing said base on a horizontal surface.

2. The assembly of claim 1, further including a plurality of indentations positioned in said upper section wherein said indentations are configured for enhancing a grip of a hand of a user positioned on said handle.

3. The assembly of claim 2, further including said plurality of indentations comprising three said indentations.

4. The assembly of claim 2, further including said indentations being arcuate.

5. The assembly of claim 1, further including a plurality of apertures positioned in said lid wherein said apertures are positioned for venting said interior space.

6. The assembly of claim 1, further including a plurality of slits positioned in said base wherein said slits are positioned for venting said interior space.

7. The assembly of claim 1, further including said interior space being substantially spherically shaped.

8. The brush assembly of claim 1, further comprising:

a plurality of indentations positioned in said upper section wherein said indentations are configured for enhancing a grip of a hand of a user positioned on said handle, said plurality of indentations comprising three said indentations, said indentations being arcuate;

said lower end of said lower section being externally threaded, said scrubber comprising:

a disc, a hole centrally positioned through said disc, a tube coupled to said disc and extending from said hole, said tube being internally threaded such that said tube is positioned for threadedly inserting said lower end of said lower section for reversibly coupling said disc to said handle, a brush coupled to said tube, said brush comprising sponge, said brush comprising a core and a plurality of bristles, said core being substantially spherically shaped, each said bristle being coupled to and extending radially from said core, and a plurality of wires, each said wire being coupled to and positioned in a respective said bristle and extending into said core wherein said wires are positioned for stiffening said bristles;

a plurality of apertures positioned in said lid wherein said apertures are positioned for venting said interior space;

a plurality of slits positioned in said base wherein said slits are positioned for venting said interior space;

an orifice positioned through a top end of said upper section;

a pin, said pin being ball lock type, said pin being positioned in said orifice and coupled to said upper section such that a button of said pin protrudes from said upper section and such that a barrel of said pin extends into said upper section;

an upper washer positioned around and coupled to said barrel adjacent to said top end of said upper section;

a lower washer positioned around said barrel proximate to a terminus of said barrel such that release balls protruding from said barrel of said pin are positioned between said lower washer and said terminus;

a coiled spring positioned around said barrel, said coiled spring being coupled to and extending between said upper washer and said lower washer wherein said button is configured for depressing for urging a spindle of said pin toward said terminus for positioning a recess of said spindle for retracting said release balls such that said coiled spring is positioned for urging said lower washer past said release balls for contacting an upper end of said lower section such that said coiled spring is positioned for extending said lower section and said medial section from said upper section from said upper section.

9. A brush assembly comprising:

a handle comprising an upper section, a lower section, and a medial section, said lower section and said medial section being nested in said upper section such that said lower section and said medial section are selectively extensible from said upper section;

a scrubber coupled to a lower end of said lower section wherein said scrubber is configured for cleaning a toilet;

a base, said base being bowl-shaped such that said base is positioned for partially inserting said scrubber;

a lid coupled to and extending from a bottom end of said upper section, said lid being bowl-shaped and complementary said base such that a perimeter of said lid is positioned for abutting a circumference of said base as said lower section is inserted into said upper section wherein said lid and said base define an interior space housing said scrubber;

said lower end of said lower section being externally threaded; and said scrubber comprising:

a disc, a hole centrally positioned through said disc, a tube coupled to said disc and extending from said hole, said tube being internally threaded such that said tube is positioned for threadedly inserting said lower end of said lower section for reversibly coupling said disc to said handle, and a brush coupled to said tube.

10. The assembly of claim 9, further including said brush comprising sponge.

11. The assembly of claim 9, further including said brush comprising a core and a plurality of bristles, said core being substantially spherically shaped, each said bristle being coupled to and extending radially from said core.

12. The assembly of claim 11, further including a plurality of wires, each said wire being coupled to and positioned in a respective said bristle and extending into said core wherein said wires are positioned for stiffening said bristles.

13. A brush assembly comprising:

a handle comprising an upper section, a lower section, and a medial section, said lower section and said medial section being nested in said upper section such that said lower section and said medial section are selectively extensible from said upper section;

a scrubber coupled to a lower end of said lower section wherein said scrubber is configured for cleaning a toilet;

a base, said base being bowl-shaped such that said base is positioned for partially inserting said scrubber;

a lid coupled to and extending from a bottom end of said upper section, said lid being bowl-shaped and complementary said base such that a perimeter of said lid is positioned for abutting a circumference of said base as said lower section is inserted into said upper section wherein said lid and said base define an interior space housing said scrubber;

an orifice positioned through a top end of said upper section;

a pin, said pin being ball lock type, said pin being positioned in said orifice and coupled to said upper section such that a button of said pin protrudes from said upper section and such that a barrel of said pin extends into said upper section;

an upper washer positioned around and coupled to said barrel adjacent to said top end of said upper section;

a lower washer positioned around said barrel proximate to a terminus of said barrel such that release balls protruding from said barrel of said pin are positioned between said lower washer and said terminus; and a coiled spring positioned around said barrel, said coiled spring being coupled to and extending between said upper washer and said lower washer wherein said button is configured for depressing for urging a spindle of said pin toward said terminus for positioning a recess of said spindle for retracting said release balls such that said coiled spring is positioned for urging said lower washer past said release balls for contacting an upper end of said lower section such that said coiled spring is positioned for extending said lower section and said medial section from said upper section from said upper section.

* * * * *